United States Patent [19]

Appelbaum

[11] Patent Number: 4,709,567

[45] Date of Patent: Dec. 1, 1987

[54] LOCK AND COVER DEVICE

[76] Inventor: Paul Appelbaum, 5115 E. Donald St., Denver, Colo. 80222

[21] Appl. No.: 739,227

[22] Filed: May 30, 1985

[51] Int. Cl.[4] ..... E05B 17/18

[52] U.S. Cl. ..... 70/455

[58] Field of Search ..... 70/54–55, 70/423, 455; 411/371–373, 377; 215/224, 343–345; 150/52.9, 52.10

[56] References Cited

U.S. PATENT DOCUMENTS

| | | | |
|---|---|---|---|
| 2,930,049 | 3/1960 | Minella | 411/373 |
| 3,740,981 | 6/1973 | Patriquin | 70/455 |
| 4,154,072 | 5/1979 | Flaschar | 70/455 |
| 4,214,505 | 7/1980 | Aimar | 411/373 |

*Primary Examiner*—Robert L. Wolfe

*Attorney, Agent, or Firm*—Charles C. Corbin

[57] ABSTRACT

A lock cover device constructed of a resilient polymeric material and adapted for use with so-called mortise or cam-locks, or the like, having a main housing mountable around the lock head and pivotally carrying a lid which snap fits into sealing relationship with the top of said housing to provide a domed configuration to the device.

9 Claims, 8 Drawing Figures

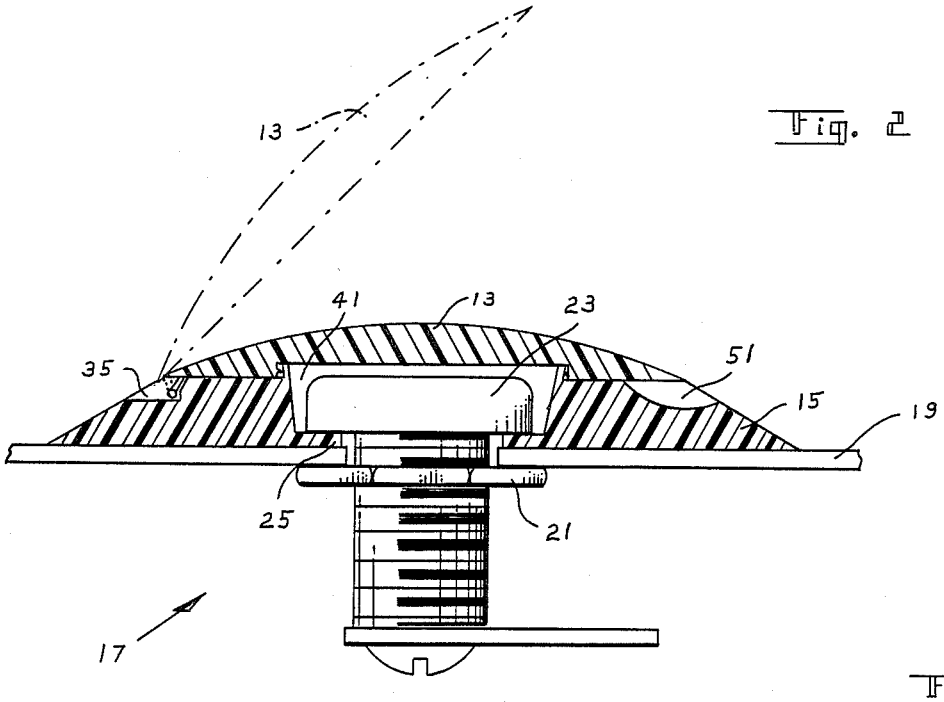
Fig. 2
Fig. 3
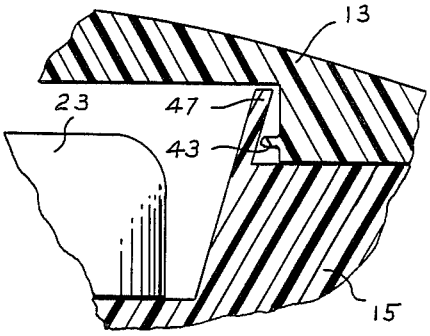
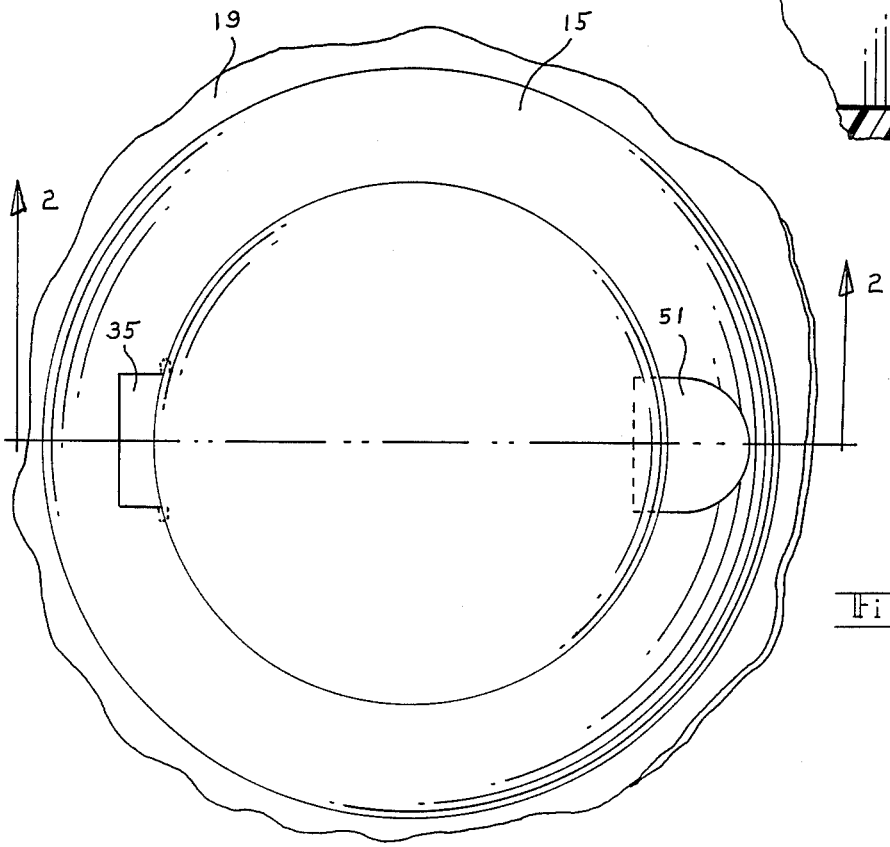
Fig. 1

Fig. 5
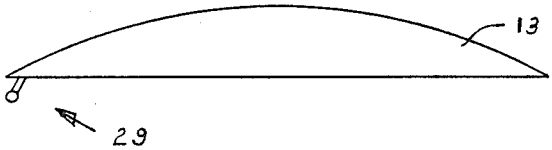
Fig. 6
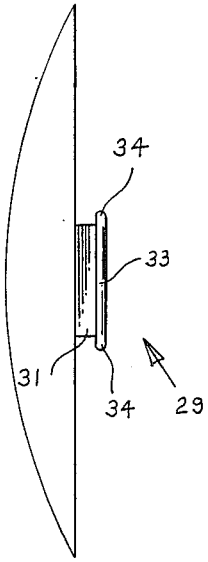
Fig. 4
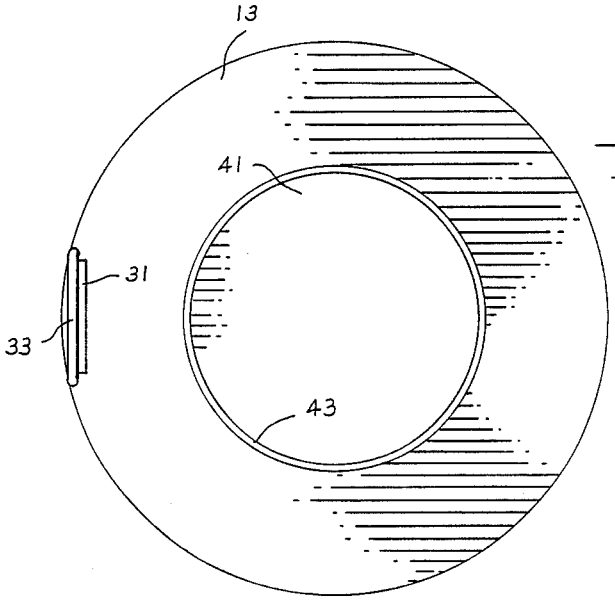
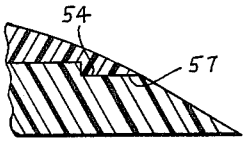
Fig. 8
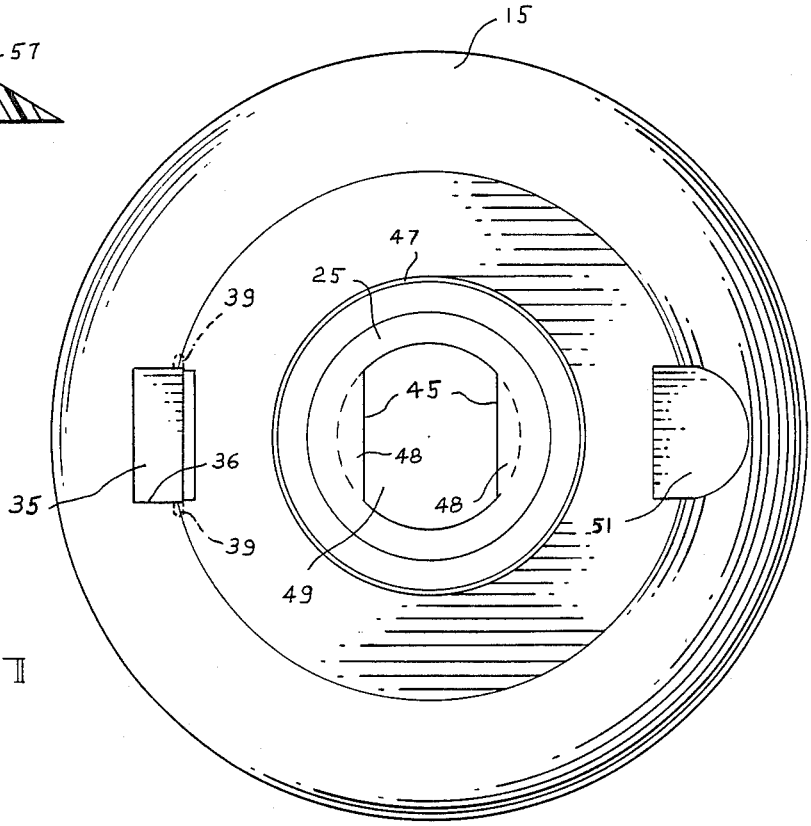
Fig. 7

LOCK AND COVER DEVICE

BACKGROUND OF THE INVENTION

1. Field of the Invention

This invention relates to lock sealing devices and more particularly to a device for unlatchably sealing the key entry area of a so-called mortise type lock, or the like from contamination caused by dust, moisture, spray and the like.

2. Description of the Prior Art

It is well known to users that over periods of time moisture, dust, and other foreign material collects within a lock's key receiving aperture. As a result, the cylinder's internal mechanisms including tumblers and springs may be fouled and jammed. This condition is aggravated when locks are used in environments of high concentration of spray, dirt and dust. In sub-freezing environments trapped moisture can freeze the lock.

Most prior efforts at covering mortise type locks have not included openable lids that seal in positive locking engagement, and device such as shown in U.S. Pat. Nos. 4,154,072 and 4,282,732 present angular, protruding and multifaceted outer surfaces which tend to intercept and accumulate dust and airborne contaminants, as well as water, snow and ice. This increases the chance of contamination of the lock by seepage of these standing contaminants. In addition it is noted that in U.S. Pat. No. 4,154,072 the area of contact between the sealing device bottom and the panel to which the lock is attached is minimal, which minimizes the length of possible paths of moisture seepage.

SUMMARY OF THE INVENTION

In view of the foregoing it is an object of the present invention to provide an inexpensive lock cover device that is readily attachable to a mortise type lock and that has a streamlined outer configuration.

Another object is to provide a lock covering device that has a lid which makes positive sealing engagement with the main body of the devoce.

A further object of the invention is to provide a device having a relatively large area of contact with the panel to which the lock is attached.

Accordingly the present invention provides a lock sealing device of resiliently deformable polymer material that has two parts—a main, annular body that is mountable around the cylinder head of a lock and having a bottom with relatively large surface area, a sloping side wall and a generally flat annular upper surface, and a circular lid pivotally mounted at the sidewall of the main body with a convex top and a flat annular bottom that matches the flat upper surface of the main body. There are interlocking male and female projections on the main body and lid respectively which deform under lid closing pressure and make positive locking engagement. There are means for mounting joint-forming posts to the periphery of the lid and means in the wall of the main body for guiding the resilient deformation and insertion of the posts into receiving sockets in the main body. In one modification there is an intermating groove and ridge on the lid and main body respectively.

BRIEF DESCRIPTION OF THE DRAWINGS

FIG. 1 is a top view of the lock cover of the invention.

FIG. 2 is a sectional view taken along the line 2—2 of FIG. 1, with an open lid shown in phantom lines.

FIG. 3 is an enlarged view of the portion encircled in FIG. 2.

FIG. 4 is a bottom view of the lid of the invention.

FIG. 5 is a side view of the lid.

FIG. 6 is an end view of the lid.

FIG. 7 is a top view of the invention with lid removed.

FIG. 8 is a partial sectional view similar to FIG. 2, but of a modification of the invention having peripheral lip and groove.

DESCRIPTION OF THE PREFERRED EMBODIMENT

As shown in FIG. 1 the lock cover device comprises two main parts constructed of a resiliently deformable polymeric material—the lid 13 and the main body 15. FIG. 2 shows the device used to weatherproof a lock assembly 17, of the so-called mortise or cam-lock type, which has been installed through a hole in the metallic wall 19 of a cabinet door. Tightening of the nut 21 urges the bottom of the lock crown 23 against the flange portion 25 of body 15, so as to draw the bottom of body 15 into sealing relationship with the surface of wall 19.

As FIGS. 4, 5 and 6 show, there is extending from an outer edge of lid 13 an integral axel portion 29, comprising arm 31 and axel 33. A slot 35 and two adjoining recesses or sockets 39, located in the side of body 15, are designed to accomodate axel portion 29. (See FIGS. 1 and 7). The attachment is accomplished by snap-fitting the two outer posts 34 of axel 33 into recesses 39. The sidewalls 36 of slot 35 are preferrably inwardly converging so as to guide the gradual deformation of axel 33 as posts 34 are forced towards engagement with sockets 39.

The underside of lid 13 is provided with circular depression 41 and circumferentially extending lip 43, as best shown in FIGS. 3 and 4. There is a circumferentially extending raised edge 47 on body 15, shown in FIGS. 2, 3 and 7, which has its largest diameter somewhat greater than the diameter of the inner edge of lip 43 such that when lid 13 is pressed downwardly against body 15, the lip 43 will flex and then snap into locking engagement as shown in FIG. 3. This will form a moisture proof seal which protects crown 23 and the inner lock mechanism contained therein.

FIG. 7 shows the flange 25 having opposite straight edges 45 which will nest with flats on the body of lock 17 such that the body 15 will not rotate relative to the lock 17. Flange 25 is scored as indicated to provide detachable tabs 47 which may be removed to give a circular central bore at 49 as desired.

A finger slot 51 enables a finger to be inserted therein for prying open the lid 13.

In the modification shown in FIG. 8 a circumferentially extending ridge 54 depends from lid 13 and fits into groove 57 carried in the top edge of body 15. This contributes to the sealing relationship of lid 13 and body 15.

In another modification the bore 49 is larger than the lock crown 23 and the bottom of body 15 has two-sided pressure sensitive adhesive tape attached thereto so that the device may be mounted directly around the lock.

Various other advantages and modifications of the above described preferred embodiment will be apparent to these skilled in the art and may be made without departing from the spirit and scope of the invention.

What is claimed is:

1. Apparatus to be mounted to a lock for releasably sealing a lock and having a keyway sealing position and an keyway exposing position, comprising:

a. resilient polymeric housing, circular in planform and having a flat annular bottom surface, said housing having a central bore extending therethrough for admitting the cylinder of said lock, the upper surface of said housing having an upwardly sloping outer portion, an intermediate flat annular portion, and a central portion sunken substantially below the plane of said intermediate portion and having a generally annular flange at the bottom of said sunken portion, bordering said central bore, and a resilient annular male locking lip extending upwardly and somewhat radially outwardly from said intermediate annular portion, and means within said sloping portion for receiving the posts of a hinge joint;

b. a resilient polymeric lid, circular in planform and having a convex upper surface and a diameter the same as the outer circular boundary of said housing intermediate portion, the bottom of said lid being flat with a central circular depression therein that has a diameter somewhat larger than said male locking lip, and the side wall of said depression having a continuous, radially inwardly extending flange defining an inner circle that is slightly smaller in diameter than the outer diameter of said male lip, and means depending from the periphery of said lid for carrying posts receivable within said post receiving means on said housing whereby said lid is pivotally mounted for rotation from an open position to a sealed position wherein the bottom of said lid lies flush with said intermediate housing portion and whereby said female finger is pressed over the male lip to form sealing and locking engagement with the outer wall of said male lip, and whereby a dome-like configuration is provided to the combined top of said apparatus.

2. Apparatus as defined in claim 1 wherein said post receiving means comprises a radially extending slot and a pair of sockets in opposite side walls of said slot, adjacent the inner wall of said slot, and wherein said post carrying means comprises a downwardly sloping member having a pair of sidewardly projecting resilient posts with the post tip to post tip distance being slightly greater than the spacing between the side walls of said slot.

3. Apparatus as defined in claim 2 wherein spacing between said slot side walls decreases from being larger than the post-to-post spacing of said posts to slightly smaller than said post-to-post spacing.

4. Apparatus as defined in claim 1 wherein a slot for insertion of the human finger extends through the sloping outer portion and somewhat into the intermediate portion of said housing.

5. Apparatus as defined in claim 1 wherein said housing is significantly less resilient than said lid.

6. Apparatus as defined in claim 1 wherein the bottom of said housing is coated withpressure sensitive adhesive.

7. Apparatus as defined in claim 1 wherein the inner edge of said annular flange has a pair of parallel straight portions.

8. Apparatus as defined in claim 7 wherein said annular flange is scored in the region of said straight edges so as to provide portions that are detachable to provide a completely circular flange edge.

9. Apparatus as defined in claim 1 wherein said intermediate housing surface has a peripherally extending groove therein and said lid bottom is adapted to fit said groove.

* * * * *